United States Patent [19]

Hollweck

[11] Patent Number: 4,496,928

[45] Date of Patent: Jan. 29, 1985

[54] TEMPERATURE RESPONSIVE SWITCH

[75] Inventor: Walter Hollweck, Nuremberg, Fed. Rep. of Germany

[73] Assignee: Thermostat- und Schaltgerätebau GmbH & Co. KG, Bad Kissingen, Fed. Rep. of Germany

[21] Appl. No.: 498,901

[22] Filed: May 25, 1983

[30] Foreign Application Priority Data

May 25, 1982 [DE] Fed. Rep. of Germany ..... 3219517

[51] Int. Cl.[3] ..... H01H 61/08; H01H 37/52

[52] U.S. Cl. ..... 337/94; 337/333; 337/360

[58] Field of Search ..... 337/82, 85, 88, 89, 337/91, 94, 333, 334, 349, 347, 360, 361, 362, 368, 369, 365, 367; 219/252

[56] References Cited

U.S. PATENT DOCUMENTS

| | | | |
|---|---|---|---|
| 2,944,130 | 7/1960 | Hallenbeck | 337/375 |
| 3,209,105 | 9/1965 | Price et al. | 337/377 |
| 3,322,918 | 5/1967 | Ulanet | 337/94 |
| 4,109,136 | 8/1978 | Balchunas | 337/360 |

FOREIGN PATENT DOCUMENTS

| | | |
|---|---|---|
| 189267 | 3/1957 | Austria . |
| 2048977 | 3/1971 | France . |
| 713454 | 8/1954 | United Kingdom . |

*Primary Examiner*—Harold Broome

*Attorney, Agent, or Firm*—Spencer & Frank

[57] ABSTRACT

A temperature responsive regulator switch for controlling the heat of an electric heating device, comprises movable and stationary electric contacts cooperating with one another for assuming open and closed positions and a bimetal operatively coupled to the movable contact for moving it into the open position when the bimetal attains a predetermined temperature. The bimetal is heated by electric current passing therethrough solely in the closed position. The regulator switch further has a heat conductor having a first part adapted to be directly exposed to the heat of the device controlled by the temperature responsive regulator switch and a second part being in a heat-conducting connection with the bimetal for heating the bimetal by the heat generated by the device.

14 Claims, 4 Drawing Figures

TEMPERATURE RESPONSIVE SWITCH

BACKGROUND OF THE INVENTION

This invention relates to a temperature responsive switch for electrically heated devices, particularly baking ovens. The temperature responsive switch may be of the type which has an electrically heated bimetal, a setting arm and a stationary contact arranged therebetween. These three components which are inserted stackwise on a securing post, such as a hollow rivet, are spaced from one another by electrically insulating discs and project from the post in the same direction, approximately parallel to one another. There is further provided a contact spring which is biased in the direction of the stationary contact and whose fixed end is secured to the movable terminus of the setting arm. The setting arm may be displaced from its mid position by pressure exerted thereon by the bimetal and by a temperature preselector. The bimetal is connected to the electric circuit of the device served by the temperature responsive switch such that when the circuit is closed, current flows through the bimetal.

A temperature responsive switch of the above-outlined known type, if serving, for example, a water heater, provides for heating the water to a preselected temperature and for maintaining the water at that temperature. Such a temperature responsive switch is an output regulator which is controlled exclusively by the current flowing through the bimetal. The heating of the bimetal occurs according to the principle of resistance heating. As soon as the water heater has reached the desired temperature, the bimetal swings the contact spring out of its contacting position into the OFF position. After a certain cooling period which starts as the heating current is interrupted, the contact spring, by virtue of its bias, swings back into the ON position whereby the heating process resumes up to the moment of the successive switch-off. Thus, in this manner, the water heater is maintained essentially at constant heat-up temperatures, and overheating is prevented by the periodic switch-offs. Further, the calorie loss due to the cooling is resupplied after a certain delay during the renewed ON periods. The temperature preselecting device effects a displacement of the movable end of the setting arm and thus causes a change of the position of the stationary end of the contact spring. By virtue of the displacement of the movable end of the setting arm the switch-off effect of the bimetal on the contact spring is made dependent from a variable, predetermined extent of deformation of the bimetal, that is, the holding temperature of the switch may be preselected.

Output regulators of the above-outlined type have the disadvantage that the heat requirement of, for example, the inner space of a baking oven is not taken into account in the regulating process. The switch-off occurs conventionally only as a function of the current flow. The periods of ON position of the output regulator are constant even during the heat-up phase with the result that the heating temperature does not increase sufficiently rapidly. It is, however, an advantage of this type of output regulator that relatively short switching times can be realized. Thus, such output regulators often work with an ON period of only 1 to 2%.

Further, temperature responsive switches are known wherein the bimetal is controlled solely by the actual temperature of the electric device served by the switch. It is a disadvantage of such temperature responsive switches that the regulating periods are too long because of the distance between the switch and the heated environment. Further, the difference between switch-off temperature and switch-on temperature has been found to be very high. The switching behavior of such temperature responsive switches has a relatively high inertia. It is, however, an advantage of this type of temperature responsive switch that regulation may be effected as a function of the necessary heat requirements.

SUMMARY OF THE INVENTION

It is an object of the invention to provide an improved temperature responsive switch of the above-outlined type which permits a rapid heat-up to the desired temperature and, upon reaching such temperature, it maintains the same within narrow limits. It is a further object of the invention to provide an improved temperature responsive switch of the above-outlined type which has a simple construction.

These objects and others to become apparent as the specification progresses, are accomplished by the invention, according to which, briefly stated, the temperature responsive regulator switch for controlling the heat of an electric heating device, comprises movable and stationary electric contacts cooperating with one another for assuming open and closed positions and a bimetal operatively coupled to the movable contact for moving it into the open position when the bimetal attains a predetermined temperature. The bimetal is heated by electric current passing therethrough solely in the closed position. The regulator switch further has a heat conductor having a first part adapted to be directly exposed to the heat of the device controlled by the temperature responsive regulator switch and a second part being in a heat-conducting connection with the bimetal for heating the bimetal by the heat generated by the device.

The temperature responsive switch according to the invention as outlined above is an output regulator controlled directly by the heat which is regulated by the switch. The current passing through the bimetal and the attained heat level of the electric device are both used for heating the bimetal. A rapid heat-up is achieved, because the temperature responsive switch according to the invention operates with a 100% ON period until the desired temperature or, as the case may be, the holding temperature is reached. After reaching the desired texperature, the control effect of the heat conductor remains constant and thus has practically no more effect and thus, the temperature responsive switch according to the invention operates with short, but relatively frequent ON periods, similarly to a conventional output regulator. Thus, the temperature reponsive switch according to the invention provides that in the heat-up period the bimetal is heated additionally by a heat conductor (temperature sensor) transmitting heat from the device served by the regulator switch, whereby during the heat-up period the periodic switch-off of the heating current characterizing conventional output regulators does not occur.

According to a further feature of the invention, the heat conductor is a sheet metal strip which is blackened in order to utilize the actual heat of the electric device, such as the heat in the baking chamber of a baking oven, without appreciable losses for the control of the motion of the bimetal, despite the fact that the switch, together with the bimetal, is situated, as a rule, externally of the inner space of the oven.

According to a further feature of the invention, the sheet metal strip is attached to a securing post and extends therefrom at an angle of 90° with respect to other components affixed to the securing post. This feature allows the temperature responsive switch to be situated immediately adjacent the space whose temperature is to be regulated, for example, in the immediate vicinity of the outer wall of a baking oven. In this manner, short regulating periods are achieved.

According to a further feature of the invention, the sheet metal strip is, at one point of its length, bent approximately 90° such that its free end portion extends approximately parallel to the securing post. This feature allows a securing of the temperature reponsive switch parallel to, for example, an oven wall.

According to further features of the invention, the bimetal member is of U-shaped configuration and is affixed to the securing post at the ends of the U legs. Further, an end of the U-shaped bimetal carries an electric terminal, while its other end is electrically connected with the stationary contact. These features provide for a simple, operationally safe structure of the temperature responsive regulator switch according to the invention.

DESCRIPTION OF THE PREFERRED EMBODIMENT

Figure 1:
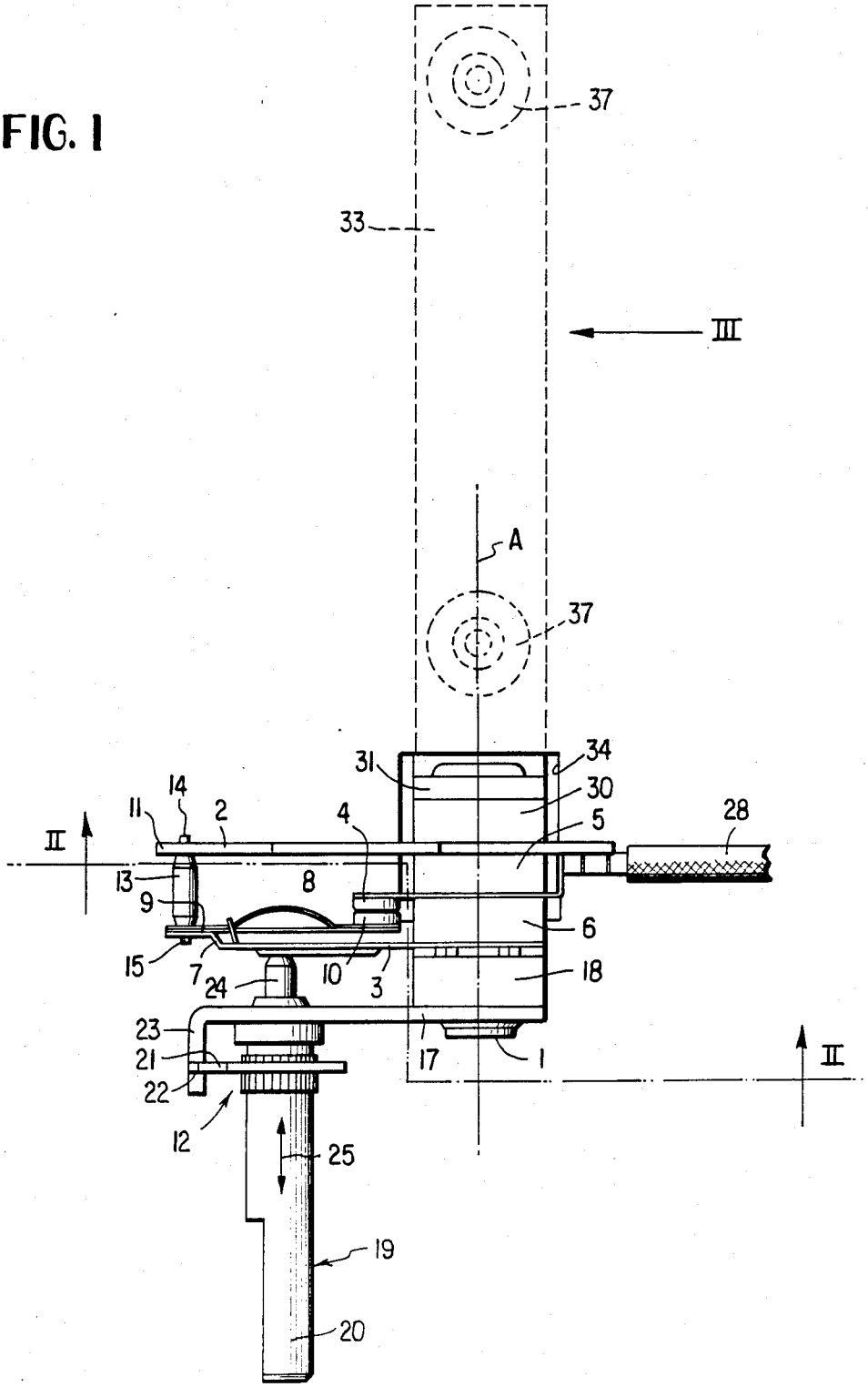
FIG. 1 is a side elevational view, on an enlarged scale, of a preferred embodiment of a temperature responsive regulator switch according to the invention.

Turning to FIG. 1, the temperature responsive regulator switch illustrated therein comprises a hollow rivet 1 constituting a securing or mounting post on which there are inserted a bimetal 2, a setting arm 3 and a stationary contact 4 situated between the components 2 and 3. The bimetal 2, the setting arm 3 and the stationary contact 4 are spaced from one another by means of electrically insulating, $Al_2O_3$ discs 5 and 6 and extend outwardly from the rivet 1 generally parallel to one another.

The fixed end 9 of a contact spring 8 is secured to the free movable end 7 of the setting arm 3 remote from the hollow rivet 1. The contact spring (movable contact) 8 is biased towards the contacting position of its movable end 10 with the stationary contact 4.

The setting arm 3 may be moved out of a mid position by the pressure exerted thereon by the movable end 11 of the bimetal 2 and by a temperature presetting device generally indicated at 12. For this purpose, between the respective movable ends 7 and 11 of the setting arm 3 and the bimetal 2 there is arranged an insulating spacer pin 13 which, by means of its tapered ends 14 and 15, projects into corresponding holes (designated at 16 in FIG. 2) provided in the movable ends 11 and 7 of the bimetal 2 and the setting arm 3. The temperature presetting device 12 is secured to the end of a support arm 17 which is affixed to the securing post 1 and is spaced from the setting arm 3 by an insulating disc 18. The support arm 17 extends radially from the axis A of the hollow rivet 1 and is parallel to the bimetal 2, the setting arm 3 and the stationary contact 4. In the zone of the free end of the support arm 17 there is rotatably supported a setting shaft 19 which carries a turning knob (not shown) at its free end 20. To the circumference of the setting shaft 19 there is secured a radially projecting spring disc 21 which has a radial projection 22. The support arm 17 has a bent terminal portion 23 which extends into the circular path of motion of the projection 22. In this manner, the rotary motion of the setting shaft 19 is limited to somewhat less than 360°.

Within the setting shaft 19 there is supported a pressure pin 24 which, upon rotation of the setting shaft 19, is displaced in the axial direction 25 and, by abutting the setting arm 3, changes the position of the movable end 7 thereof.

Figure 2:
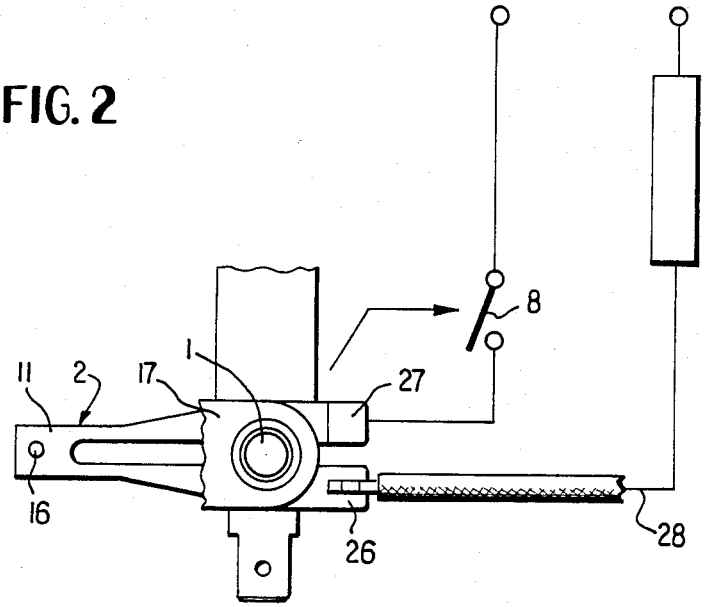
FIG. 2 is a sectional view, taken along line II—II of FIG. 1.
Figure 4:
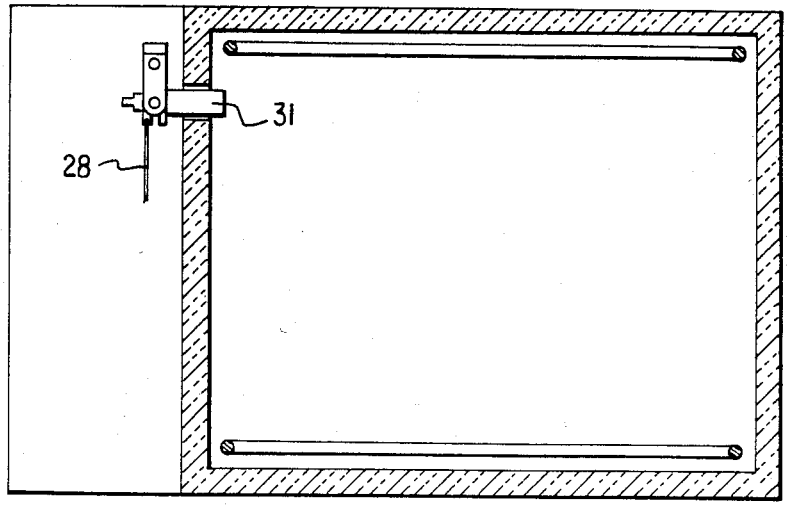
FIG. 4 is a sectional elevational view of a baking oven, supporting a temperature responsive regulator switch according to the invention, as viewed in the direction of arrow IV of FIG. 3.

As shown in FIG. 2, the bimetal 2 is of U-shaped configuration, comprising legs 26 and 27. The bimetal is secured to the hollow rivet 1 at the end zone of the U legs 26 and 27. The two legs 26 and 27 are insulated from one another and from the hollow rivet 1 by means of an insulating insert. The end of the leg 26 is connected with a current terminal 28. The current path extends from the end of the leg 26 through the movable end 11 of the bimetal 2 to the end of the other leg 27 and then downwardly to the stationary contact 4. In the ON position, the current path extends through the movable end 10 of the contact spring 8 to its stationary end 9 and therefrom, through the setting arm 3 to the terminal post 29 (FIG. 3) for the other phase of the conductor (not shown).

A blackened sheet metal strip 31, made of a superior heat conducting material, such as aluminum or copper is fastened to the hollow rivet 1 adjacent the bimetal 2 and being spaced therefrom by means of an electrically insulating disc 30 made of a superior heat conducting material, particularly $Al_2O_3$. The sheet metal strip 31 extends from the hollow rivet 1 approximately 90° offset with respect to the bimetal 2, the setting arm 3, the stationary contact 4 and the support arm 17. The sheet metal strip 31 has a bend 32 of approximately 90° such that the free terminal portion 33 of the strip 31 extends approximately parallel to the longitudinal axis A of the hollow rivet 1.

Figure 3:
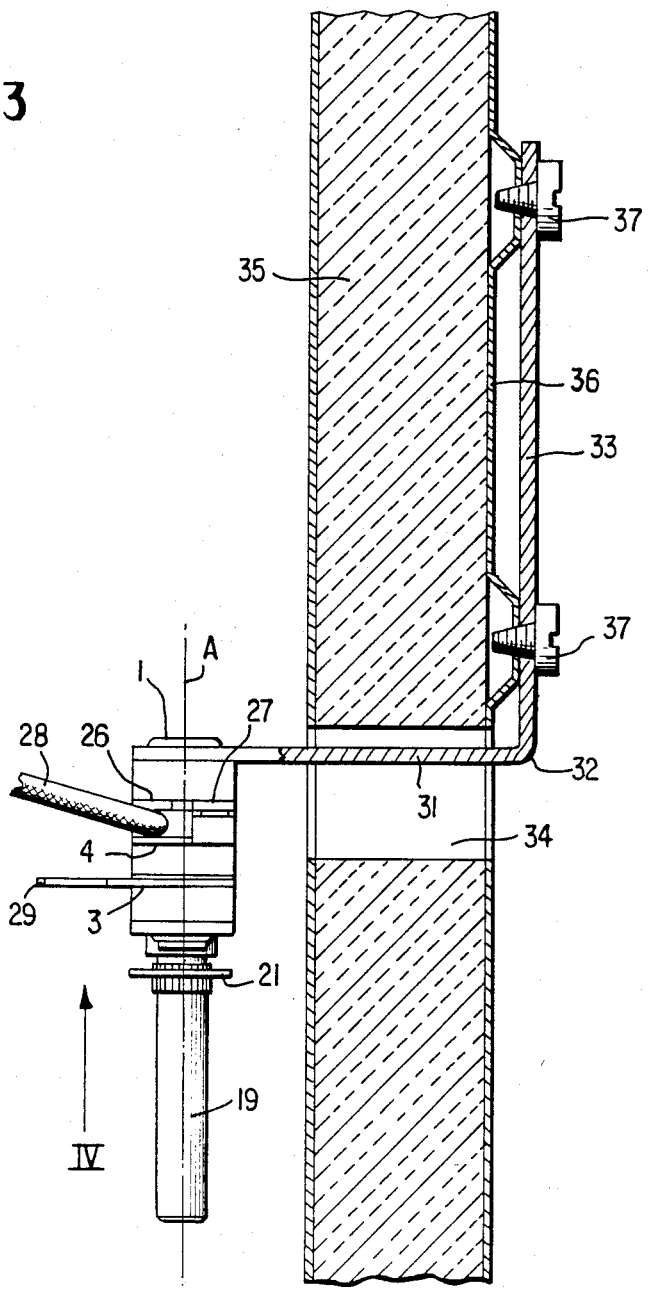
FIG. 3 is a side elevational view of the preferred embodiment taken in the direction of the arrow III of FIG. 1, shown in a mounted state on an oven wall, illustrated in section.

Turning now to FIG. 3, the sheet metal strip 31 passes through an opening 34 provided in the wall 35 of a baking oven. The temperature responsive switch is situated in the zone externally of the baking oven, whereas the free end 33 of the sheet metal strip 31 is situated within the baking space and is affixed with screws 37 to the inner lining 36 of the baking oven wall.

The temperature responsive regulator switch described in detail above, provides that the ON and OFF switching of the heating current is caused by the combined heating effect of the device to be regulated and the current passing through the bimetal. During the start-up period, that is, when the regulated device begins to heat up from a cold state, the heat supplied to the bimetal by virtue of the current flowing therethrough (resistance heating) will not be sufficient to cause a great enough deformation of the bimetal for opening the switch contacts, since during the heat-up phase the heat transferred to the bimetal by the sheet metal strip 31 is still too low. Thus, the combined effect of the heat from the environment sensed by the sheet metal strip 31 and that derived from the current flowing through the bimetal 2 has not yet reached the triggering value. After such a value is reached, the bimetal opens the switch contacts, thus immediately cutting off the heat source derived from the current flow, whereas the heat source from the environment continues to supply heat by means of the sheet metal strip 31. The ON-OFF cycle will oscillate about a relatively narrow temperature range as the combined effect from the two temperature sources alternatingly reach and fall below, respectively, the switch opening and switch closing temperatures.

It will be understood that the above description of the present invention is susceptible to various modifications, changes and adaptations, and the same are intended to be comprehended within the meaning and range of equivalents of the appended claims.

What is claimed is:

1. A temperature responsive regulator switch for controlling the heat of an electric heating device, comprising:

(a) movable and stationary electric contacts cooperating with one another for assuming open and closed positions;

(b) bimetal means operatively coupled to said movable contact for moving said movable contact into said open position when said bimetal means attains a predetermined temperature; said bimetal means being heated by electric current passing therethrough solely in said closed position;

(c) heat conducting means having a first part adapted to be directly exposed to the heat of the device controlled by the temperature responsive regulator switch and a second part being in a heat-conducting connection with said bimetal means for heating said bimetal means by the heat generated by the device; and (d) an electric insulating element of $Al_2O_3$ separating said bimetal means from said heat conducting means.

2. A temperature responsive regulator switch as defined in claim 1, wherein said heat conducting means comprises a sheet metal strip.

3. A temperature responsive regulator switch as defined in claim 2, wherein said sheet metal strip is copper.

4. A temperature responsive regulator switch as defined in claim 2, wherein said sheet metal strip is aluminum.

5. A temperature responsive regulator switch as defined in claim 2, wherein said sheet metal strip is blackened.

6. A temperature responsive regulator switch for controlling the heat of an electric heating device, comprising:

(b) bimetal means operatively coupled to said movable contact for moving said movable contact into said open position when said bimetal means attains a predetermined temperature; said bimetal means being heated by electric current passing therethrough solely in said closed position;

(c) a heat conducting sheet metal strip having a first part adapted to be directly exposed to the heat of the device controlled by the temperature responsive regulator switch and a second part being in a heat-conducting connection with said bimetal means for heating said bimetal means by the heat generated by the device; and (d) a securing post; said stationary contact, said bimetal means and said sheet metal strip being inserted on said securing post.

7. A temperature responsive regulator switch as defined in claim 6, wherein said first and second electrically insulating discs are $Al_2O_3$.

8. A temperature responsive regulator switch as defined in claim 6, further comprising a first electrically insulating disc inserted on said securing post between said stationary contact and said bimetal means and a second electrically insulating disc inserted between said bimetal means and said sheet metal strip.

9. A temperature responsive regulator switch as defined in claim 6 wherein said securing post has a longitudinal axis; and further wherein said bimetal means and said stationary contact are parallel to one another and extend radially away from said securing post; said sheet metal strip extending radially away from said securing post and being offset approximately 90° with respect to said stationary contact and said bimetal means.

10. A temperature responsive regulator switch as defined in claim 9, further comprising a setting arm inserted on said securing post and extending radially therefrom; said setting arm coupling said movable contact to said bimetal means; said setting arm extending parallel to said bimetal means and said stationary contact; further comprising a first electrically insulating disc inserted on said securing post between said stationary contact and said bimetal means; a second electrically insulating disc inserted on said securing post between said bimetal means and said sheet metal strip; a third electrically insulating disc inserted on said securing post between said stationary contact and said setting arm; and a temperature presetting means supported on said securing post and operatively coupled to said movable contact for adjusting the position of said movable contact.

11. A temperature responsive regulator switch as defined in claim 6, wherein said securing post has a longitudinal axis; said sheet metal strip having a length portion extending parallel to said longitudinal axis; said length portion comprising said first part of said heat conducting means.

12. A temperature responsive regulator switch as defined in claim 11, wherein said length portion is a first length portion; further wherein said sheet metal strip has a second length portion extending from said securing post in a direction radially away therefrom; said second length portion continuing in said first length portion with a 90° bend.

13. A temperature responsive regulator switch as defined in claim 6, further wherein said bimetal means comprises a U-shaped bimetal having first and second legs each having a free end; said bimetal being secured to said securing post in the zone of the free ends of said legs.

14. A temperature responsive regulator switch as defined in claim 13, further comprising an electric terminal connected to the end of said first leg; the end of said second leg being electrically connected to said stationary contact.

* * * * *